United States Patent [19]

Sanford

[11] 4,342,887

[45] Aug. 3, 1982

[54] NORMALLY CLOSED PRESSURE RESPONSIVE SWITCH WITH IMPROVED COMPACT STRUCTURE

[75] Inventor: Carlton E. Sanford, Riverside, R.I.

[73] Assignee: Texas Instruments Incorporated, Dallas, Tex.

[21] Appl. No.: 178,275

[22] Filed: Aug. 15, 1980

[51] Int. Cl.[3] ..... H01H 35/34

[52] U.S. Cl. ..... 200/83 P; 92/103 M

[58] Field of Search ..... 200/83 R, 83 P, 83 J, 200/81 R, 246, 283, 302; 92/7, 13.2, 101, 103 M; 73/378.3

[56] References Cited

U.S. PATENT DOCUMENTS

| | | | |
|---|---|---|---|
| 2,391,238 | 12/1945 | Horman | 200/159 R |
| 2,549,740 | 4/1951 | Yonkers | 335/207 |
| 2,640,896 | 6/1953 | Cataldo | 335/205 |
| 3,133,170 | 5/1964 | Nanninga | 200/67 R |
| 3,194,074 | 7/1965 | Anderson | 73/363 |
| 3,553,402 | 1/1971 | Hire | 200/83 P |
| 3,875,358 | 4/1975 | Willcox | 200/83 P |
| 4,091,249 | 5/1978 | Huffman | 200/83 P |
| 4,194,974 | 3/1980 | Johnsson | 210/90 |
| 4,200,776 | 4/1980 | Poling | 200/83 P |
| 4,287,780 | 9/1981 | Poling | 74/100 P |

*Primary Examiner*—Gerald P. Tolin

*Attorney, Agent, or Firm*—James P. McAndrews; John A. Haug; Melvin Sharp

[57] ABSTRACT

A compact, low cost, pressure responsive electrical switch of improved reliability has simple and easily assembled contacts movable on a base between open and closed circuit positions. A dished metal disc is operably connected with a diaphragm to move with snap action between original and inverted dished configurations for moving the contacts sharply between such circuit positions when selected pressures are applied to the diaphragm. The contacts are biased to open the circuit; a first, convex side of the disc engages and holds the contacts firmly in closed circuit position against the noted bias when the disc is in its original dished configuration; a selected diameter portion of that first side of the metal disc engages an annular ridge on the base; and a motion transfer member is located between the diaphragm and the opposite side of the disc, the member having an annular ridge of relatively larger diameter than the ridge on the base engaging a correspondingly larger diameter portion on the opposite side of the disc near the disc periphery. The member moves in response to application of a selected pressure to the diaphragm to press the disc against the annular base ridge to snap the disc to its inverted configuration and to withdraw the originally convex disc side away from the contacts for permitting the contacts to follow the disc movement to fully and reliably open the device circuit.

6 Claims, 2 Drawing Figures

NORMALLY CLOSED PRESSURE RESPONSIVE SWITCH WITH IMPROVED COMPACT STRUCTURE

BACKGROUND OF THE INVENTION

This invention relates to pressure switches for use in automobiles, tractors and other heavy equipment and the like to provide an electrical signal or output in response to the occurence of selected pressures in the equipment during equipment operation. The invention relates more particularly to pressure switches having improved compactness, simplicity and reliability to make them more suitable for widespread use in automobiles.

Conventional pressure switches include contact means which are movable between open and closed circuit positions. The switches usually have a domed disc spring arranged to move from one dished configuration to an inverted configuration with snap action for moving the contacts sharply between those two circuit positions when sufficient force is applied to the disc. A diaphragm is exposed to fluid pressures in a zone to be monitored and is arranged to apply such a force to the disc when a selected level of pressure is applied to the diaphragm. In one commonly used pressure switch of that type, the contact means are biased to a closed circuit position. The disc is rested on its periphery or rim to extend over the contacts with the domed or convex side of the disc facing the diaphragm. A motion transfer member is located between the diaphragm and disc and has an annular portion which rests against a selected diameter portion of the convex side of the disc when the disc is in its original configuration. The member moves in response to the application of selected pressure to the diaphragm to apply force to that selected diameter of the disc to snap the disc to its inverted dished configuration. As the disc moves to that inverted configuration, it engages and moves the contact means to open circuit position against the normal contact bias. In that arrangement, it is found that some difficulty is encountered in incorporating the contacts in the switch in a compact and inexpensive way while also assuring that there will be adequate spacing between switch components of opposite polarity after the switch has opened in response to the occurrence of an overload pressure or the like. The pressure responsive devices also tend to be held in closed circuit position with less force than would be desired in many applications involving significant equipment vibration.

It is an object of this invention to provide a novel and improved pressure responsive device having improved compactness, reliability and simplicity for widespread use in automobiles.

BRIEF SUMMARY OF THE INVENTION

Briefly described, the pressure responsive device of this invention comprises a molded dielectric base of a generally cylindrical configuration. An annular ridge of a selected diameter is provided at one end of the base integral with the base and fixed and movable contact means are mounted on that same end of the base. The movable contact means include a resilient contact arm which is movable between open and closed circuit positions but which is biased to an open position spaced from the fixed contact means. A dished disc spring of a metal material or the like is incorporated in the device to be movable from an original dished configuration to an inverted dished configuration with snap action in response to the application of a selected force.

In accordance with this invention, the dished disc spring is arranged so that a selected diameter portion of a first side of the disc rests on and engages the annular ridge on the base and so that, when the disc is in its original dished configuration, that first disc side is convex and engages and holds the movable contact means firmly in closed circuit position against the bias of the resilient contact arm. Diaphragm means are mounted in the device to be exposed to pressures in a zone whose pressure is to be monitored and a motion transfer means is mounted between the diaphragm means and the disc to move in response to a pressure applied to the diaphragm means. The motion transfer member has an annular ridge portion of relatively larger diameter than the annular ridge on the base. The ridge on the motion transfer member is positioned to engage and bear against a correspondingly larger diameter of the disc at the opposite side of the disc near the disc periphery. The member presses the disc against the smaller diameter base ridge with a selected force when a selected pressure is applied to the diaphragm means so that the disc snaps to its inverted dished configuration wihtdrawing its central portion away from the contact means so that the contact means follow the disc movement and move to open circuit position in response to the bias of the resilient contact arm.

In that arrangement, simple, low cost, contact means are used; the contact means are compactly accommodated in the device; the contact means are firmly held in closed circuit position with desired contact pressure by the strong force of the dished disc spring; and the contact means are easily and accurately positioned in the device with assurance that there will be adequate electrical spacing between components of opposite polarity when the device moves to open circuit position.

BRIEF DESCRIPTION OF THE DRAWING

Other objects, advantages and details of the pressure responsive device of this invention appear in the following detailed description of preferred embodiments of the invention, the detailed description referring to the drawings in which.

DESCRIPTION OF PREFERRED EMBODIMENTS

Figure 1:
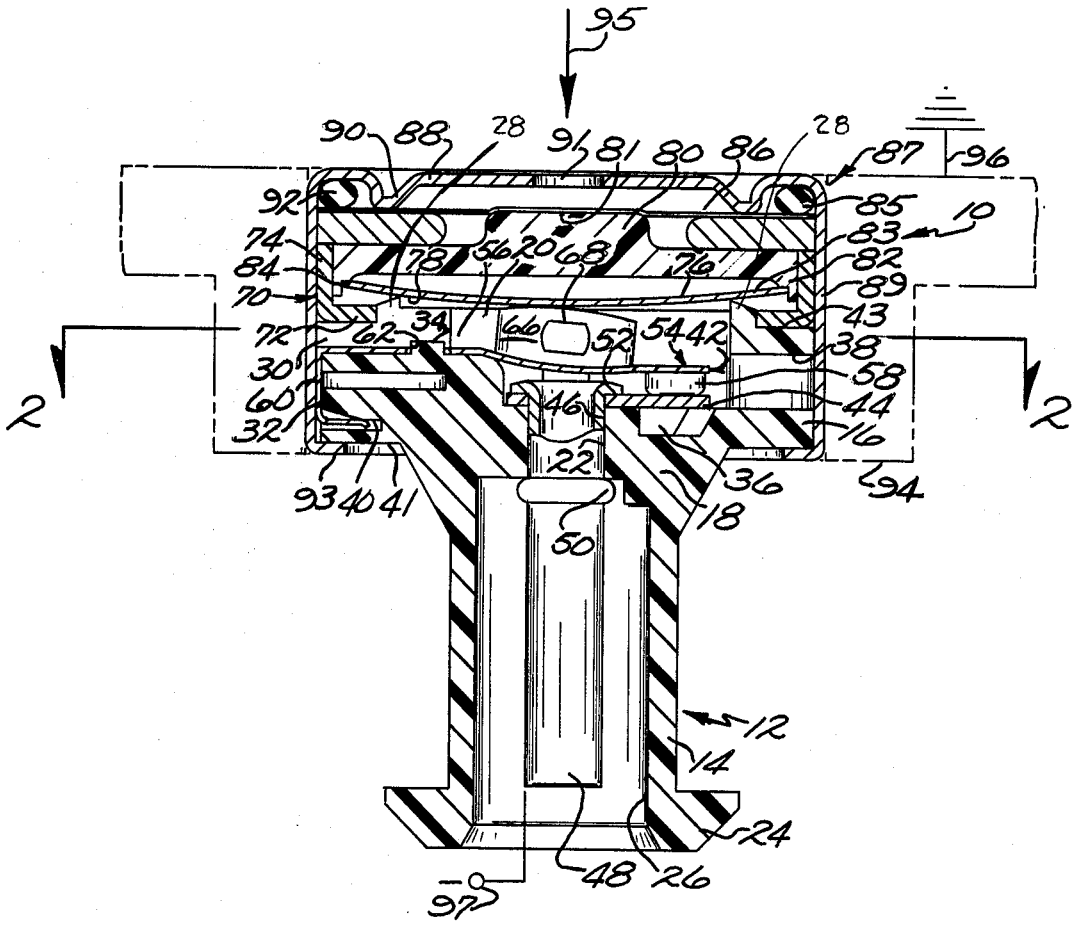
FIG. 1 is a section view along the longitudinal axis of the device provided by this invention.
Figure 2:
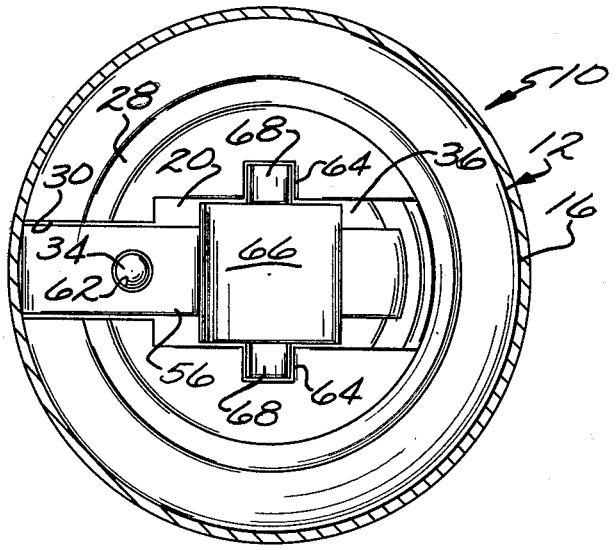
FIG. 2 is a section view along line 2—2 of FIG. 1.

Referring to the drawings, 10 in FIGS. 1 and 2 indicates the pressure responsive device of this invention which includes a base 12 preferably molded in one piece using suitably rigid dielectric material such as glass-filled nylon or the like. The base preferably has a cylindrical configuration as shown. That is, the base preferably has a cylindrical intermediate part 14; has a cylindrical flange 16 of relatively large diameter molded integral with the base at a first end 18 of the base; has a recess 20 formed in that first end of the base; has an axial bore 22 extending from the recess to the opposite end 24 of the base; and has a counterbore 26 extending into the base at the opposite base end. In accordance with this invention, an annular ridge 28 is molded integral with the base at the first end of the base. Preferably, as shown, the base ridge 28 is formed concentric with the flange 16 and with the bore 22, and a notch 30 extends through the ridge into the recess 20. In a preferred embodiment, the molded base 12 has a slot 32 aligned with the notch 30 along the edge of the flange 16, has a boss 34 upstanding in the notch 30, has a clearance space 36 formed in the bottom of the recess 20, has an opening 38 extending through the base ridge 28 to give access to the area of the clearance space 36, and has detent surface formed by a slot 40 extending into the flange 16 as shown in FIG. 1. Preferably the ridge 28 has a configuration along its upper edge which is narrow consistent with bearing principles as shown in FIG. 1 and a flat surface 43 is provided on the base end 18 outside and extending around the ridge as shown in the drawings.

Simple and inexpensive fixed contact means 42 are easily mounted and positioned on the base at the first end 18 of the base within the recess 20. Preferably for example, the fixed contact means include a flat contact plate 44 having an opening 46, the contact being positioned in the recess with the contact opening alinged with the bore 22 to extend over the clearance space 36. The fixed contact means also includes a rivet-type terminal which secures the contact 44 to the base. Preferably for example, a tube terminal 48 is swaged to form a shoulder 50 which is abutted with the bottom of the counterbore 26 so that an end 52 of the terminal extends through the base bore 22 and through the contact opening 46 to be rolled over or riveted to secure the contact to the base.

Simple and inexpensive movable contact means 54 are also easily and accurately mounted at the first end 18 of the base to be moved into and out of engagement with the fixed contact means 42 to close and open an electrical circuit. Preferably for example, the movable contact means includes a resilient contact arm 56 of an electrically conductive metal spring material such as beryllium copper or the like. The arm preferably has a contact element 58 secured at one end of the arm and has a U-shaped arm portion 60 formed at the opposite end of the arm. The arm preferably has an opening 62 therein. The arm is mounted on the base 12 by snapping the U-shaped arm portion into the slots 32 and 40 so that the main part of the arm extends through the notch 30 in the annular base ridge 28 to locate the contact element 58 over the fixed contact plate 44. The boss 34 fits into the arm opening 62 to cooperate with the U-shaped arm portion in securely mounting the arm on the base 12. The arm is resiliently movable into and out of engagement with the fixed contact means 42 and is biased by its inherent resilience to move to an open circuit position spaced from the contact 44. Preferably the base 12 has slots 64 formed therein to face into the recess 20 and the movable contact means 54 includes a spacer 66, preferably with a rounded rocker shape as shown, having key portions 68 which are slidably fitted into the slots 64. The spacer rests on top of the resilient arm 56 and is movable up and down in the slots as the arm is moved. Afer the fixed and movable contact means are assembled as above described, a spacer ring 70 having a flange part 72 and a sleeve part 74 is mounted on the flat base surface 43 so that the spacer sleeve 74 extends above the level of the base ridge 28.

The pressure device 10 further includes a conventional dished or domed disc spring 76 formed of stainless steel or the like which is adapted to move from an original dished configuration as shown in FIG. 1 to an inverted dished configuration with snap action when sufficient force is applied to the disc as will be understood. In accordance with this invention, the disc is positioned in the device 10 with the first side 78 of the disc resting on the annular base ridge 28 as shown in FIG. 1. That is, the first side 78 of the disc is arranged so that a selected diameter of that first disc side 78 engages the narrow edge on the annular base ridge 28. When the disc is in its original dished configuration as shown in FIG. 1, the first side 78 of the disc is convex in shape so that it also engages and holds the resilient contact arm 56 in closed circuit position against the inherent arm bias through engagement with spacer 66.

A motion transfer member 80 of aluminum or the like is mounted on top of the disc 76, the member having one flat surface 81 of selected size at one end and having an annular ridge portion 82 of a diameter relatively larger than the annular base ridge 28 previously described. The motion transfer member is arranged so that the annular ridge 82 engages and bears against a correspondingly larger diameter portion of the opposite side 83 of the snap disc 76 at a location near the disc periphery 84. As shown, the disc side 83 is normally concave when the disc is in its original configuration as shown in FIG. 1. A steel washer 85 or the like is rested on the spacer sleeve 74 to extend over part of the motion transfer member 80, and a pliable diaphragm 86 is placed over the washer. Preferably for example, the diaphragm is formed of a tough, temperature resistance material such as polyimide or the like sold under the designation Kapton or H-film or the like.

A deep-drawn, electrically conductive, metal, cup-shaped casing 87 is fitted over the motion transfer member 80 and the diaphragm 86 for securing the diaphragm and motion transfer member to the base 12 in selected position relative to the disc 76 as above described. Preferably for example, the casing has a bottom 88 and a side wall 89, the bottom being embossed as at 90 to form a pressure ring to bear against the diaphragm 86 and having a central opening 91 through which the diaphragm is adapted to be exposed to fluid pressures as indicated by the arrow 95. An O-ring gasket or the like 92 is preferably fitted into the corner of the case bottom and the casing side wall is fitted over the base flange 16 and is rolled or swaged under the flange 16 as indicated at 93 for securing the casing to the base 12. That is, the casing side wall is rolled under the flange 16 for drawing the casing bottom down to seal the gasket 92 to the diaphragm 86 against the washer 85, for pressing the embossment 90 against the diaphragm to limit gasket compression, and for securing the electrically conductive resilient contact arm 56 in place on the base 12 while also making firm electrical engagement of the casing 87 to the contact arm.

In that construction, the diaphragm 86 moves in response to fluid pressures applied through the opening 91 to move the annular ridge 82 of the motion transfer member against the disc periphery to snap the disc to its inverted dished configuration as will be understood. That disc movement withdraws the originally convex side 78 of the disc away from the movable contact means so that the movable contact means follow the disc movement and open the device circuit in response to the bias of the resilient arm 56. The relative proportions of the member surface 81 and of the diameters of the annular ridges 28 and 82 cooperate with the characteristics of the disc 76 so that the motion transfer member snaps the disc to its inverted configuration to open the device circuit in response to the application of a precisely predetermined pressure to the diaphragm 86.

Of course, when that applied pressure is removed, the disc is preferably adapted to snap back to its original dished configuration to reclose the device circuit. If desired, access to the flat contact 44 is made through the opening 38 for selectively deforming contact 44 to calibrate the device 10.

The casing 87 is adapted to be press-fitted into an opening in a chamber wall as indicated by the broken lines 94 in FIG. 1, thereby to expose the diaphragm 86 to a fluid pressure as is diagrammatically indicated by the arrow 95. That mounting of the casing also serves to electrically connect the casing to electrical ground through the chamber wall as is diagrammatically shown at 96 in FIG. 1. The tube terminal 48 is also connected in an electrical control circuit as indicated at 97. In that way, movement of the disc 76 to open the device circuit in response to the application of a selected pressure 95 provides a selected electrical output from the device as will be understood.

In the device 10 as above described, the contact means 42 and 54 are of simple and inexpensive construction. They are easily and compactly mounted on the base 12 in such a way that the disc 76 is adapted to normally hold the contact means firmly in closed circuit position. However, when the disc snaps to its inverted configuration and the contact means follow the disc movement, the movable contact means and associated device components of corresponding electrical clarity are well and fully spaced from the fixed contact means.

It should be understood that although particular embodiments of this invention have been described by way of illustrating the invention, this invention includes all modifications and equivalence of the described embodiments falling within the scope of the appended claims.

I claim:

1. A normally closed pressure switch device comprising first contact means, second contact means movable between an open circuit position spaced from the first contact means and a closed circuit position engaging the first contact means, a dished disc movable with snap action between original and converted dished configurations to sharply move the second contact means between said circuit positions, diaphragm means movable in response to applied pressure, and motion transfer means movable with the diaphragm means to move the disc between said disc configurations to open and close the circuit in response to selected changes in the pressure applied to the diaphragm means, characterized in that the second contact means are biased to move away from the first contact means to open the circuit, the disc has first and opposite sides which are respectively convex and concave when the disc is in said original dished configuration, the disc having said first, convex side engaged with the second contact means to hold the second contact means in closed circuit position against said bias when the disc is in said original configuration, annular means of a selected diameter engage a corresponding diameter portion of said first disc side, and the motion transfer means has an annular portion of relatively larger diameter than said selected diameter concentrically engaging a correspondingly larger diameter portion of said opposite disc side to press against the disc in response to movement of the diaphragm means for moving the disc to said inverted disc configuration to open the circuit in response to the application of selected pressure to the diaphragm means.

2. A normally closed pressure responsive switch device comprising base means having annular means of a selected diameter thereon, first contact means mounted on the base means, second contact means mounted on the base means to be movable between an open circuit position spaced from the first contact means and a closed circuit position engaging the first contact means, said second contact means being biased to said open circuit position, a resilient dished disc spring movable with snap action from an original dished configuration to an inverted dished configuration, the disc having first and opposite sides which are respectively convex and concave when the disc is in said original dished configuration, having said first convex disc side engaged with the second contact means in closed circuit position against said bias when the disc is in original dished configuration, and having a portion of said first disc side corresponding in diameter to said annular means engaging said annular means, diaphragm means movable in response to applied pressure, and motion transfer means having an annular portion of relatively larger diameter than said annular means of the base means concentrically engaging a correspondingly larger diameter portion of said opposite disc side, the motion transfer means being movable with the diaphragm means to press upon said relatively larger diameter portion of the opposite disc side to move the disc to said inverted dished configuration to open the circuit in response to the application of a selected level of pressure to the diaphragm means.

3. A pressure responsive device as set forth in claim 2 wherein the base means comprises a generally cylindrical member of dielectric material having an integral flange of relatively large diameter at one end thereof, said annular means is integral with the base member as said one end, the first contact means is mounted on the member at said one end, and the second contact means comprises a resilient electrically conductive contact arm having a U-shaped portion fitted over the base flange mounting the arm on the member with an opposite end of the arm extending across the axis of the annular means to be engageable with the first contact means, the contact arm being resiliently biased to move to open circuit position spaced from the first contact means.

4. A pressure responsive device as set forth in claim 3 wherein the second contact means further comprises a dielectric member mounted for sliding movement on the base member between the disc and said contact arm for transmitting disc movement to the arm.

5. A pressure responsive device as set forth in claim 3 wherein the base means further comprises housing means mounting the disc, the diaphragm means, and the motion transfer means on the base member, the housing including an electrically conductive metal casing which is fitted over the base member flange in electrical engagement with said U-shaped contact arm portion for securing the arm to the base member and permitting the arm to be connected in an electrical circuit.

6. A pressure responsive device as set forth in claim 5 wherein the first contact means comprises deformable terminal means secured to the base member to be connected in an electrical circuit, the base member having a recess for receiving part of the terminal means therein to permit the terminal means to be deformed for calibrating the device.

* * * * *